US005111538A

United States Patent [19]

Chapman

[11] Patent Number: 5,111,538

[45] Date of Patent: May 12, 1992

[54] KNOCKDOWN PORTABLE HOTWATER SHOWER AND SHOWER HEAD THEREFOR

[76] Inventor: Donald L. Chapman, P. O. Box 744, Meadow Vista, Calif. 95722

[21] Appl. No.: 533,087

[22] Filed: Jun. 4, 1990

[51] Int. Cl.[5] ..... A47K 3/22

[52] U.S. Cl. ..... 4/599; 4/603; 4/615

[58] Field of Search ..... 4/603, 602, 599, 615, 4/616, 617, 598; 239/548, 556; 126/9 R

[56] References Cited

U.S. PATENT DOCUMENTS

| | | | |
|---|---|---|---|
| 1,372,598 | 3/1921 | Buka | 4/598 |
| 1,386,176 | 8/1921 | Holmes | 4/598 |
| 1,663,735 | 3/1928 | Talbot et al. | 4/599 |
| 1,844,038 | 5/1931 | Hooker | 4/602 |
| 2,308,452 | 1/1943 | Ortyl | 4/603 |
| 2,567,506 | 9/1951 | Bowman | 4/598 |
| 3,067,434 | 12/1962 | Neal et al. | 4/598 |
| 3,080,568 | 3/1963 | Burnett | 4/599 |
| 3,332,091 | 7/1967 | Greer | 4/603 |
| 3,431,565 | 3/1969 | Nelson | 4/599 |
| 3,600,720 | 8/1971 | Marshall | 4/602 |
| 3,606,618 | 9/1971 | Veech | 4/603 |
| 3,646,618 | 3/1972 | Johnson | 4/599 |
| 4,453,280 | 6/1984 | Greenleaf | 4/603 |
| 4,956,883 | 9/1990 | Lane | 4/615 |

FOREIGN PATENT DOCUMENTS

| | | | |
|---|---|---|---|
| 31918 | 2/1908 | Austria | 4/598 |
| 65019 | 11/1864 | France | 4/603 |
| 678164 | 2/1929 | France | 4/598 |

*Primary Examiner*—Charles E. Phillips
*Attorney, Agent, or Firm*—Bernhard Kreten

[57] ABSTRACT

A knockdown, portable hot water shower and shower head therefor is disclosed. The shower includes a gas burner, so that an adequate hot water supply is always provided. A unique shower head permits the use of a pump that is powered by a small energy source, such as "D" cell batteries. The shower head has a special arrangement of the apertures formed in the face thereof, so that even water delivered thereto at a low pressure by a small pump may be delivered to a user as a water spray. The shower is readily disassemblable and the components thereof are either nested in the water reservoir or are carried thereon for easy storage and transportability when not in use. This nesting arrangement permits the use of a gas burner in a portable shower.

23 Claims, 2 Drawing Sheets

KNOCKDOWN PORTABLE HOTWATER SHOWER AND SHOWER HEAD THEREFOR

FIELD OF THE INVENTION

The present invention relates to knockdown, portable, hot water showers and shower heads therefor.

BACKGROUND OF THE INVENTION

Portable showers are well known. Portable showers have been disclosed that can be relatively easily knocked down or disassembled and that can be used in a variety of places and situations. Examples of such knockdown portable showers of which I am aware are as follows:

| INVENTOR | PATENT NO. | ISSUE DATE |
|---|---|---|
| TALBOT, ET AL. | 1,663,735 | March 27, 1928 |
| ORTYL | 2,308,452 | January 12, 1943 |
| BOWMAN | 2,567,506 | September 11, 1951 |
| BURNETT | 3,080,568 | March 12, 1963 |
| NELSON | 3,431,565 | March 11, 1969 |
| VEECH | 3,606,618 | September 21, 1971 |
| JOHNSON | 3,646,618 | March 7, 1972 |
| GREENLEAF | 4,453,280 | June 12, 1984 |

Each of the above-listed references, while being useful for its purpose, suffers from at least one of several drawbacks.

Particular problems have been encountered with providing an adequate hot water supply. Often, in an attempt to keep such showers small and portable, resort has been made to solar-powered and other similar types of small heat sources. Unfortunately, such energy (heat) sources are usually not powerful enough to provide the desired supply of hot water. Traditionally, the use of a gas burner to heat the water has been avoided in portable showers due to their size and bulk.

Another problem often encountered is that, in an attempt to keep such showers small and portable, resort is often had to the use of gravity or small pumps, requiring a power source to pump or otherwise deliver water to an individual when showering. Such means for supplying and delivering the water often results in inadequate water pressure being built up or provided to deliver the water as a fine spray. Thus, use of a large powerful power source, such as an automotive or other large battery is often required.

Thus, it can be seen that there remains a need for a simple knockdown, portable hot water shower which can provide: an adequate supply of hot water, a fine water spray during shower and still be readily portable for storage or transportation in a single easy-to-carry container.

SUMMARY OF THE INVENTION

It is a primary object of the present invention to provide a knockdown, portable, hot water shower that is simple in construction, readily assemblable for use anywhere as desired, and readily disassemblable for the transportation and/or storage thereof.

It is another primary object of the present invention to provide such a portable shower that utilizes a gas burner in order to heat the water supply thereof, such that an adequate supply of hot water is provided and yet which shower is arranged, so that when knocked down, the gas burner may be nested with the remainder of the components of the shower for easy transportation and storage therewith.

It is still another primary object of the present invention to provide such a portable shower that has a unique shower head that delivers water in a fine spray, even when the water is delivered thereto at a relatively low pressure, such as from a small pump powered by common household batteries.

It is still yet another object of the present invention to provide such a portable shower that, in addition to being readily and easily knocked down, the components thereof may be received in a storage container, being nested therein to provide compactness necessary for easy transportation and storage.

In accordance with the teachings of the present invention, a knockdown portable hot water shower is disclosed. This shower has a disassembled configuration utilized for storing and transporting the shower when not in use. The shower has an assembled configuration utilized for showering by an individual when in use.

The shower includes:

(1) A container for use as a storage container when the shower is in the disassembled configuration. Components of the portable shower are received in the container for the storage thereof. Also the container is used as a reservoir when the shower is in the assembled configuration, wherein water is received and heated therein for the use thereof.

(2) A gas burner including a burner head is positioned below the container when the shower is in the assembled configuration. In this manner, the water in the container is heated for showering by an individual when in use. The gas burner is sized for being received in the container when the shower is in the disassembled configuration. In this manner, the gas burner is stored when not in use.

(3) Means is provided for supporting the container, including the shower head above the burner when the shower is in the assembled configuration.

(4) A flexible water conduit is provided that has a first lower end and a second upper end. The conduit extends upwardly from the container when the shower is in the assembled configuration. In this way, hot water is delivered upwardly through the conduit from the first end to the second end for showering by an individual when in use. A shower head is carried by the second end of the flexible water conduit above the container when the shower is in the assembled configuration. In this manner, hot water is delivered from the second end of the conduit and passes therethrough being delivered therefrom as a hot water spray for showering by an individual when in use. The shower head is received in the container when the shower is in the disassembled configuration, wherein the shower head is stored when not in use. Means is provided for supporting the flexible water conduit with the second end carrying the shower head thereon above the first end of the conduit when the shower is in the assembled configuration.

(5) A pump is positioned between the water in the container and the first end of the water conduit when the shower is in the assembled configuration. This pump, pumps the hot water from the container, through the conduit, to the shower head, wherein hot water is delivered for showering by an individual when in use.

Arranged as described above, when the shower is in the assembled configuration, the shower may be readily knocked down into the disassembled configuration and the components thereof may be carried by the container with at least a portion of the components nested therein.

Finally, the container includes a handle for transporting the portable shower when in the disassembled configuration, and all of the components of the shower may be transported in the container when not in use.

Preferably, the pump is an electric pump that is powered by a plurality of "D" cell batteries or other means commonly carried by campers.

In further accordance with the teachings of the present invention, the gas burner is a propane or butane burner.

In still further accordance with the teachings of the present invention a shower head is disclosed. When utilized on a portable shower, this shower head permits the shower to utilize a relatively small pump that does not create much water pressure. The shower head has a plurality of apertures formed therein. A first portion of the apertures are arranged and spaced in a first, inner five-point star configuration. A second portion of the apertures are arranged in a second outer five-point star configuration that surrounds the inner configuration. Preferably, the apertures of the inner and outer five-point star configurations are not aligned with one another. The apertures are cylindrical in shape allowing formation of an appropriate discharge of water. Such an arrangement permits even low pressure water received in the head to exit therefrom as a water spray.

These and other objects of the present invention will become apparent from a reading of the following detailed specification, taken in conjunction with the enclosed drawings.

DESCRIPTION OF PREFERRED EMBODIMENTS

Figure 5:
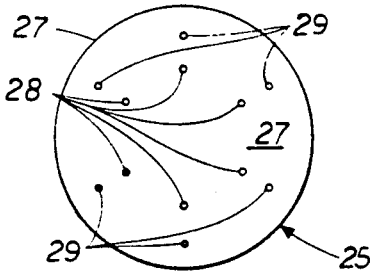
FIG. 5 is a front view of the shower head in an alternative embodiment to FIG. 8 of the present invention taken along line V—V of FIG. 1.
Figure 7:
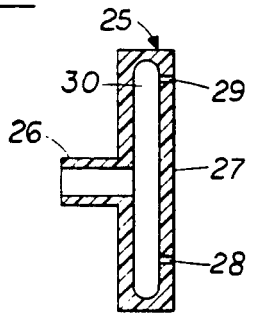
FIG. 7 is a cross-section view of the shower head taken along lines VII—VII of FIG. 8.
Figure 8:
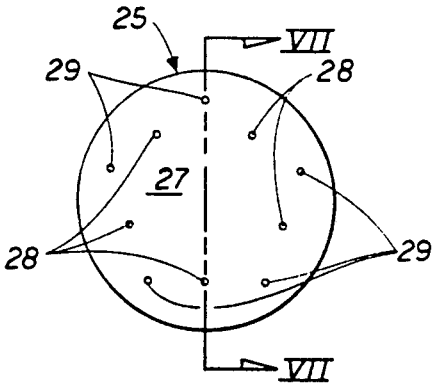
FIG. 8 is a front view of the shower head taken along line V—V of FIG. 1 in its preferred form.

Referring first to FIGS. 5, 7 and 8, the shower head 25 of the present invention is illustrated. This shower head 25 has a unique arrangement of the apertures on the face thereof, which permits a fine water spray from the shower head 25, even if the water is being delivered to the shower head at a relatively low pressure.

The shower head 25 includes an inlet 26, wherein water enters the head 25. Opposite the inlet 26 is a shower face 27 having a plurality of apertures 28 and 29 formed therein. Preferably, these apertures 28 and 29 are substantially cylindrical in shape. An empty space 30 separates the inlet 26 from the face 27 in the interior of the shower head.

A first portion 28 of the apertures are arranged on the face 27 spaced about thereon in a first inner five-point star configuration. A second portion 29 of the apertures are arranged on the face spaced about thereon in a second outer five-point star configuration. Preferably, the apertures 28 and 29 of the inner and outer five-point star configurations are substantially disaligned with one another, approximating a pentagon formation. An analogous six-point star configuration is shown in FIG. 5.

Figure 3:
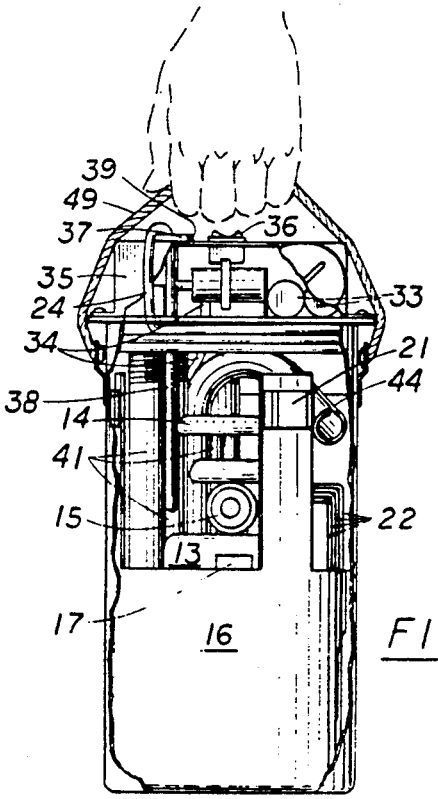
FIG. 3 is a side view of the shower of the present invention in the disassembled configuration, wherein the components thereof are nested in a storage container for the easy transportation thereof and with parts thereof broken away to show the nesting arrangement in the container.

Referring now to the drawings generally, the knockdown, portable, hot water shower 10 is illustrated. This shower 10 has a disassembled configuration utilized for storing and transporting the shower 10 when not in use (FIG. 3). The shower 10 further has an assembled configuration utilized for showering by an individual when in use (FIG. 1).

Figure 1:
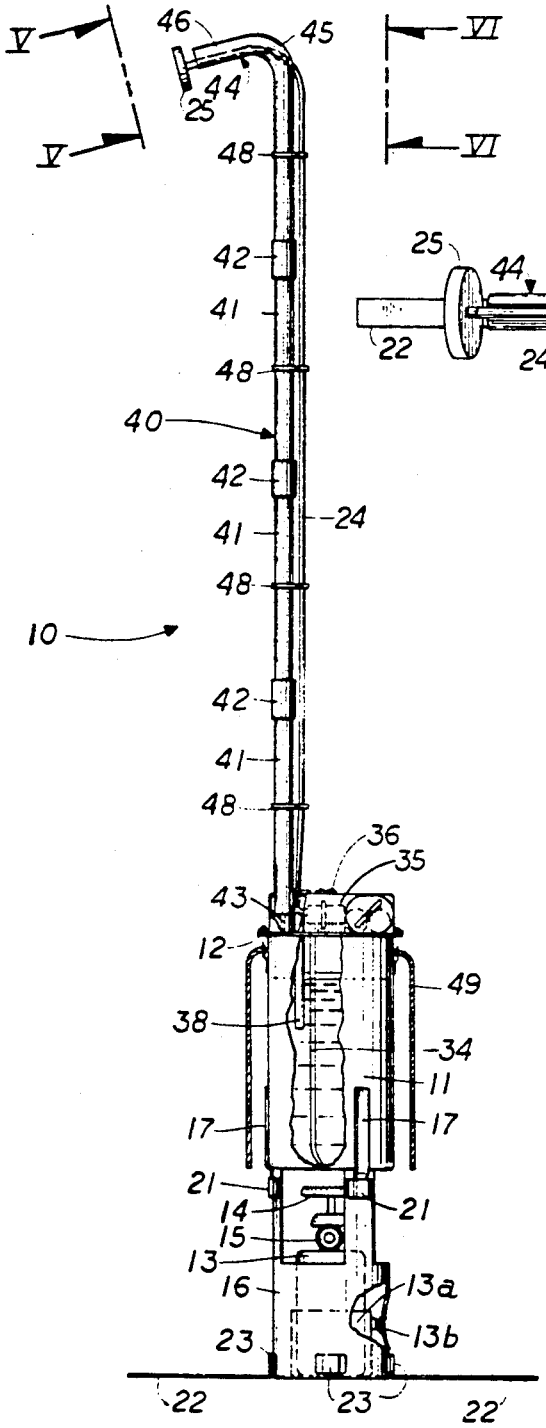
FIG. 1 is a side view of the knockdown, portable hot water shower of the present invention, in the assembled configuration, with portions thereof broken away for the sake of clarity.
Figure 2:
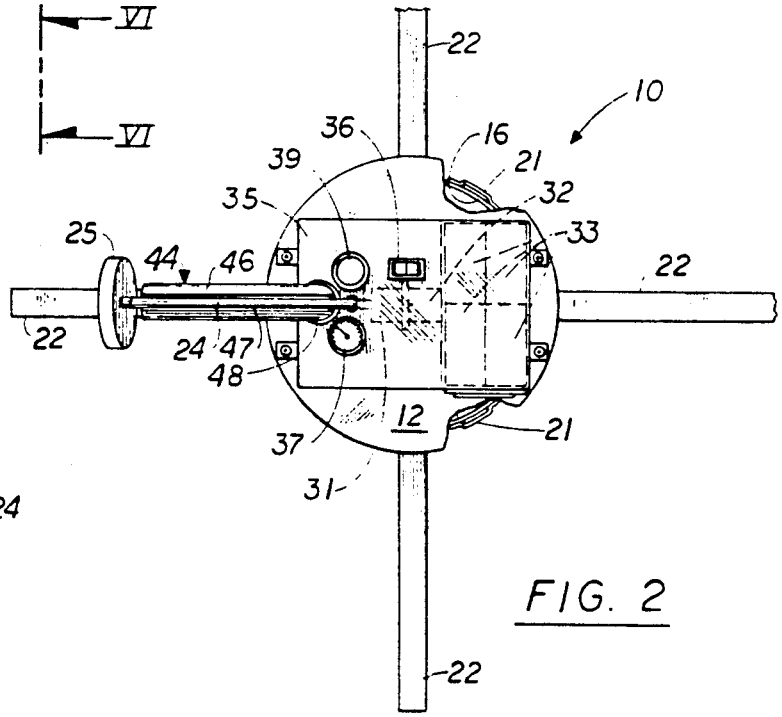
FIG. 2 is an overhead view of the shower of FIG. 1.
Figure 4:
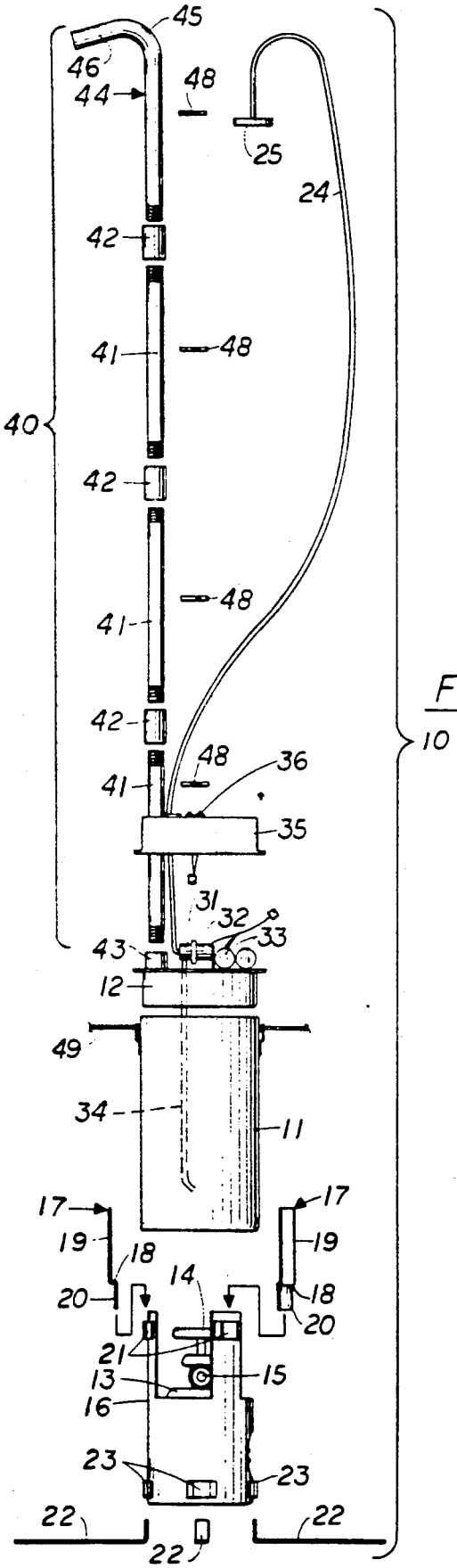
FIG. 4 is an exploded view of the shower of FIG. 1 showing how the shower is easily knocked-down.

Referring in particular now to FIGS. 1, 2 and 4, when in the assembled configuration, the shower 10 has container 11 which serves as a reservoir, wherein water is received and heated for use thereof. Preferably, this reservoir 11 is substantially cylindrical in shape including a side wall, a bottom wall and an open top. Also, it is preferred that this container 11 be fabricated from aluminum or any other suitably conductive material, so as to facilitate the heating of the water disposed therein, as will be discussed below.

It is contemplated herein that the container will be sized to have a liquid capacity of at least two gallons. However, for best heating of the water and most efficient use of the shower 10, a two gallon capacity is preferred.

Removably disposed on the container 11, extending over the open top thereof is a lid 12. Lid 12 is tight-fitting, so that the water stored in the container 11 is retained therein.

Disposed below the container 11 is a gas burner 13. This gas burner 13 includes a burner head 14 for heating the water in the container 11. This burner includes an on/off valve 15 for manually controlling and adjusting the flow of gas and the height of the flame from the burner head 14. The burner 13 is, preferably, a propane gas burner, a butane gas burner or any other gas burner normally utilized by campers to heat water. This heated water may then be used for showering by an individual when the shower 10 is in use.

Surrounding and housing the gas burner 13 and the burner head 14 thereof is a support housing 16. Interposed between housing 16 and burner 13 is a sleeve 13*a* fixed in housing 16. A set of screws 13*b* fixes the burner 13 to the housing 16 via sleeve 13*a*. This support housing 16 has openings formed therein, providing access to the valve 15, so the gas flow may be turned on or off or otherwise adjusted, and further so that the burner head 14 may be lit.

Supported on the top of the housing 16 is the container 11. Since the support housing 16 is sized so as to be nested in the container 11 with the gas burner 13 nested therein when the shower 10 is in the disassembled configuration, when supported on the housing 16, the container 11 circumferentially overhangs the support housing 16. Accordingly, a means is provided for supporting the container 11 above the gas burner 14.

The means for supporting the container 11 above the burner head 14 includes a plurality of support uprights 17. Each of these support uprights 17 has a shoulder 18 formed therein (see, in particular, FIG. 4). Each of the support uprights 17 has a stabilizing portion 19 extending upwardly from the shoulder 18 and a tab portion 20 extending downwardly from the shoulder 18. The tab portions 20 of the uprights 17 are removably received in respective brackets 21 formed on the side wall of the support housing 16 and circumferentially spaced thereabout. In this manner, the support uprights 17 are carried by the support housing 16, extending upwardly therefrom. Formed thusly, the container 11 is received on and circumferentially supported by the shoulder 18. The stabilizing portions 19 circumferentially surround the container 11, thereby stabilizing and further supporting the container 11.

The support housing 16 further includes a plurality of stabilizing legs 22 that extend substantially outwardly from the housing 16. Legs 22 include a bent portion which extends upwardly therefrom, defining a tab portion. Each of the tab portions are removably received in respective brackets 23 that are spaced circumferentially about the support housing 16 and are secured thereto. In this fashion, legs 22 are removably carried by the housing 16 for stabilizing the shower 10 during use thereof.

A flexible water conduit 24 is provided. Conduit 24 has a first lower end and a second upper end. The water conduit 24 extends substantially upwardly from the first lower end, so that the second upper end is located above both the first lower end and the container 11.

Carried on the second upper end of the water conduit 24 is the shower head 25, described at length above. This second end of the water conduit 24 is joined to the inlet 26 of the shower head 25.

Disposed on and carried by the lid 12 is a pump 31. Pump 31 is driven by, preferably, an electric motor 32 which, in turn, is, preferably, powered by a plurality of "D" sized cell batteries 33, or any other relatively small power unit, commonly in the possession of campers and the like. Such small power units may be utilized because, due to the unique arrangement of the shower head 25 (as discussed above) a powerful pump is not necessary.

The pump 31 is removably connected to the second upper end of a siphon conduit 34. The first lower end of the siphon conduit 34 is disposed in the water in the container, so as to extend to substantially the bottom wall of the container 11. The pump 31 is further connected to the first lower end of the water conduit 24.

In the above fashion, hot water in the container may be pumped by the pump 31 from the first end to the second end of the siphon conduit and further from the first end to the second end of the water conduit 24, where it is received by the shower head 25 for delivery in a water spray to an individual when in use.

Pump 31, motor 32 and batteries 33 are all housed in a housing 35 carried by the lid 12. Also carried on the housing 35 is an on/off switch 36 for controlling operation of the motor 32 and the pump 31.

Further removably carried by the lid 12 is a thermometer. The thermometer includes a display portion 37 carried by the housing 35. The thermometer further includes a downwardly extending probe portion 38 that extends from the lid 12 and into the water in the container 11. In this fashion, the temperature of the water being heated in the container 11 is constantly measured by the probe portion 38 and displayed on the display portion 37.

An alarm 39 is also housed in the housing 35. This alarm may be a sound alarm (such as a horn), a visual alarm (such as a light) or any other alarm desired. The alarm 39 is operatively connected to the thermometer so that when the thermometer senses that the water in the container 11 reaches a preselected temperature (such as 100° F.), the alarm is activated, warning the user of the shower 10 that the water in the container 11 has attained the temperature selected. This protects the user from receiving water that is too hot for their desire. The alarm 39 will stop when, for example, the motor 32 is turned on using switch 36.

Secured to the container 11 is a means for supporting the flexible water conduit 24 with the second end thereof carrying the shower head 25 above the first end of the conduit 24. This means includes an integral knockdown upstanding support 40. The upstanding support is comprised of a plurality of support portions 41, that are axially, removably secured to one another to form the integral support 40. In this respect, each of the support portions 41 includes a pair of threaded ends. A plurality of threaded collars 42 matingly engage adjoining threaded ends of axially adjacent support portions 41, joining the portions 41 to one another. The lower most support portion 41 is matingly engaged in a threaded collar 43 on the lid 12, whereby the upstanding support 40 is supported.

Figure 6:
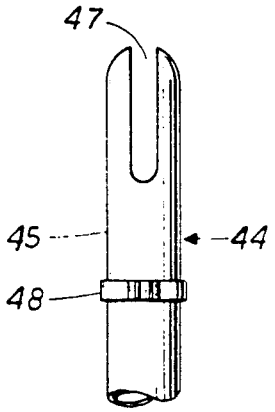
FIG. 6 is an end view of the uppermost support portion of the present invention taken along lines VI—VI of FIG. 1.

With reference now to FIG. 6, the uppermost support portion 44 has a bend 45 formed therein forming an outwardly extending portion 46. This portion 44 has a slot 47 formed therein at the bend 45 thereof and extending outwardly along the portion 46. In this fashion, the water conduit 24 including the second end thereof may be received and supported in the slot 47 with the shower head 25 being directed substantially outwardly to deliver the hot spray of water to an individual during use of the shower 10.

It is to be noted that, if desired, the conduit 24 and the shower head 25 may be removed from this upstanding support 40 for use as a hand-held shower head.

A plurality of clips 48 are provided as a means to removably secure the water conduit 24 to the upstanding support 40. Each of the clips 48 has a first end that is removably secured (clipped) to the upstanding support 40 along the length thereof. Each of the clips 48 further has a second end that is removably secured (clipped) to the water conduit 24, along the length thereof. In this fashion, the water conduit 24 is removably secured to and supported by the support 40 when in the assembled configuration.

Finally, the container 11 includes a removable handle 49. The handle 49 may, for example, be in the form of a rope secured at both ends to respective ears formed on the side wall of the container, or any other suitable form. The handle 49 is used for transporting the shower 10 when knocked down and placed in the disassembled configuration.

When assembled as described above, the shower 10 may be readily knocked down into the disassembled configuration. In this disassembled configuration, the components of the shower 10 are carried by the container 11 with at least a portion of the components nested therein and with the remainder of the components carried thereon.

With reference now to FIGS. 3 and 4, the disassembled configuration is illustrated, as described above. All of the components of the shower 10 are either nested in or carried on the container 11 for easy transport thereof using the handle 49. In this respect, the container is used as a storage container.

The uprights 17, stabilizing legs 22, support portions 41, and collars 42 are all nested within support housing 16, circumferentially spaced about the burner 13. Support housing 16 is nested within container 11. The water conduit (which passes through an aperture so formed in the lid 12) 24 is substantially received in the container being wound circularly and nested on the other components located therein. The shower head 25 is also nested in the container 11. Finally, loose components, such as clips 48 are disposed in the bottom of the support housing 16.

Once all the elements have been knocked-down and nested in the container 11, as described above, the lid 12 may be placed on the container 11, thereby retaining and storing the components therein. The pump 31, thermometer 37, alarm 39, and motor 32, batteries 33 and on/off switch 36 are all housed in the housing 35 and carried on the lid 12.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A knockdown portable hot water shower having a disassembled configuration utilized for storing and transporting the shower when not in use, and an assembled configuration utilized for showering by an individual when in use, the knockdown portable hot water shower is comprised of:

a container for use as a storage container when the shower is in the disassembled configuration, wherein components of the portable shower are received therein for the storage thereof, and further for use as a reservoir when the shower is in the assembled configuration, wherein water is received and heated therein for the use thereof;

a gas burner including a burner head which is positioned above the gas burner and both of which are positioned below the container when the shower is in the assembled configuration, wherein the water in the container is heated for showering by an individual when in use, the gas burner and burner head sized for being received in the container when the shower is in the disassembled configuration, wherein the gas burner is stored when not in use;

means for supporting the container above the gas burner;

a flexible water conduit having a first lower end and a second upper end, the conduit extending upwardly from the container when the shower is in the assembled configuration, wherein hot water is delivered upwardly through the conduit from the first end to the second end for showering by an individual when in use;

a shower head carried by the second end of the flexible water conduit above the container when the shower is in the assembled configuration, wherein hot water delivered from the second end of the conduit passes therethrough and is delivered therefrom as a hot water spray for showering by an individual when in use, the shower head being received in the container when the shower is in the disassembled configuration, wherein the shower head is stored when not in use;

means for supporting the flexible water conduit with the second end carrying the shower head thereon above the first end of the conduit when the shower is in the assembled configuration;

a pump between the water in the container and the first end of the water conduit when the shower is in the assembled configuration for pumping the hot water from the container, wherein hot water is delivered for showering by an individual when in use;

wherein when the shower is in the assembled configuration, the shower may be readily knocked-down into the disassembled configuration and the components thereof may be carried by the container with at least a portion of the components nested therein; and the container including a handle for transporting the portable shower when in the disassembled configuration, wherein all of the components of the shower may be transported therewith when not in use.

wherein the means for supporting the container above the gas burner in the assembled configuration is comprised of:

a support housing for housing the gas burner therein when the shower is in the assembled and disassembled configurations, and further for supporting the container thereon above the gas burner when the shower is in the assembled position, the support housing being sized, so as to be nested in the container with the gas burner nested therein, when the shower is in the disassembled configuration.

2. The knockdown portable hot water shower of claim 1, wherein the gas burner is a propane gas burner.

3. The knockdown portable hot water shower of claim 1, wherein the gas burner is a butane gas burner.

4. The knockdown portable hot water shower of claim 1, wherein the means for supporting the container above the gas burner in the assembled configuration is further comprised of:

a plurality of support uprights carried by the support housing and extending upwardly therefrom, each of said uprights having a shoulder formed therein, such that the container is received on and supported by the shoulders when in the assembled configuration, the support uprights further being removable from the housing so that when in the disassembled configuration, the support uprights may be removed from the housing and received in the container so as to be nested therein for storage when not in use.

5. The knockdown portable hot water shower of claim 4, wherein the support uprights further include stabilizing portions extending upwardly from the shoulders, whereby the container is stabilized and further supported by the support uprights when in the assembled configuration.

6. The knockdown portable hot water shower of claim 1, wherein the support housing further includes a plurality of stabilizing legs extending substantially outwardly from the housing for stabilizing the housing when the shower is in the assembled configuration.

7. The knockdown portable hot water shower of claim 6, wherein the stabilizing legs are removable from the housing and received in the container, so as to be nested therein when the shower is in the disassembled configuration for storage when not in use.

8. The knockdown portable hot water shower of claim 1, wherein the pump is an electric pump powered by a plurality of "D" cell batteries.

9. The knockdown portable hot water shower of claim 1, wherein the pump includes a siphon conduit having a first lower end disposed in the water in the container and a second upper end connected to the pump when the shower is in the assembled configuration, wherein hot water in the container is delivered to the water conduit.

10. The knockdown portable hot water shower of claim 1, further comprised of:

a lid removably disposed over the container, thereby sealing the container for storing and retaining the water therein when the shower is in the assembled configuration and further for storing and retaining components therein when the shower is in the disassembled configuration.

11. The knockdown portable hot water shower of claim 1, wherein the shower head has a plurality of substantially cylindrical apertures formed therein, such that in the assembled position, water received in the shower head from the second end of the water conduit exits therefrom as a hot water spray to an individual when showering, a first portion of the apertures arranged spaced in a first, inner five-point star configuration and a second portion of the apertures arranged spaced in a second, outer five-point star configuration that surrounds the inner configuration.

12. The knockdown portable hot water shower of claim 11, wherein the apertures of the inner and outer five-point star configurations are disaligned with one another, approximating a pentagon formation.

13. A knockdown portable hot water shower having a disassembled configuration utilized for storing and transporting the shower when not in use, and an assembled configuration utilized for showering by an individual when in use, the knockdown portable hot water shower is comprised of:

a container for use as a storage container when the shower is in the disassembled configuration, wherein components of the portable shower are received therein for the storage thereof, and further for use as reservoir when the shower is in the assembled configuration, wherein water is received and heated therein for the use thereof;

a gas burner including a burner head which is positioned above the gas burner and both of which are positioned below the container when the shower is in the assembled configuration, wherein the water in the container is heated for showering by an individual when in use, the gas burner and burner head sized for being received in the container when the shower is in the disassembled configuration, wherein the gas burner is stored when not in use;

means for supporting the container above the gas burner and burner head when the shower is in the assembled configuration;

a flexible water conduit having a first lower end and a second upper end, the conduit extending upwardly from the container when the shower is in the assembled configuration, wherein hot water is delivered upwardly through the conduit from the first end to the second end for showering by an individual when in use;

a shower head carried by the second end of the flexible water conduit above the container when the shower is in the assembled configuration, wherein hot water delivered from the second end of the conduit passes therethrough and is delivered therefrom as a hot water spray for showering by an individual when in use, the shower head being received in the container when the shower is in the disassembled configuration, wherein the shower head is stored when not in use;

means for supporting the flexible water conduit with the second end carrying the shower head thereon above the first end of the conduit when the shower is in the assembled configuration;

a pump between the water in the container and the first end of the water conduit when the shower is in the assembled configuration for pumping the hot water from the container, wherein hot water is delivered for showering by an individual when in use;

wherein when the shower is in the assembled configuration, the shower may be readily knocked-down into the disassembled configuration and the components thereof may be carried by the container with at least a portion of the components nested therein;

the container including a handle for transporting the portable shower when in the disassembled configuration, wherein all of the components of the shower may be transported therewith when not in use, a lid removably disposed over the container, thereby sealing the container for storing and retaining the water therein when the shower is in the assembled configuration and further for storing and retaining components therein when the shower is in the disassembled configuration, and a thermometer carried by the lid and extending downwardly therefrom into the container and the water therein when the shower in in the assembled configuration for continuously measuring the temperature of the water in the container during the use thereof.

14. The knockdown portable hot water shower of claim 13, wherein the shower is further comprised of:

an alarm connected to the thermometer, such that, when in the assembled configuration, the thermometer senses that the water in the container reaches a preselected temperature, the alarm is activated warning the user of the shower that the water in the container has attained the temperature sensed.

15. A knockdown portable hot water shower having a disassembled configuration utilized for storing and transporting the shower when not in use, and an assembled configuration utilized for showering by an individual when in use, the knockdown portable hot water shower is comprised of:

a container for use as a storage container when the shower is in the disassembled configuration, wherein components of the portable shower are received therein for the storage thereof, and further for use as a reservoir when the shower is in the assembled configuration, wherein water is received and heated therein for the use thereof;

a gas burner including a burner head which is positioned above the gas burner and both of which are positioned below the container when the shower is in the assembled configuration, wherein the water in the container is heated for showering by an individual when in use, the gas burner and burner head sized for being received in the container when the shower is in the disassembled configuration, wherein the gas burner is stored when not in use;

means for supporting the container above the gas burner and burner head, when the shower is in the assembled configuration;

a flexible water conduit having a first lower end and a second upper end, the conduit extending upwardly from the container when the shower is in the assembled configuration, wherein hot water is delivered upwardly through the conduit from the first end to the second end for showering by an individual when in use;

a shower head carried by the second end of the flexible water conduit above the container when the shower is in the assembled configuration, wherein hot water delivered from the second end of the conduit passes therethrough and is delivered therefrom as a hot water spray for showering by an individual when in use, the shower head being received in the container when the shower is in the disassembled configuration, wherein the shower head is stored when not in use;

means for supporting the flexible water conduit with the second end carrying the shower head thereon above the first end of the conduit when the shower is in the assembled configuration;

a pump between the water in the container and the first end of the water conduit when the shower is in the assembled configuration for pumping the hot water from the container, wherein hot water is delivered for showering by an individual when in use;

wherein when the shower is in the assembled configuration, the shower may be readily knocked-down into the disassembled configuration and the components thereof may be carried by the container with at least a portion of the components nested therein;

the container including a handle for transporting the portable shower when in the disassembled configuration, wherein all of the components of the shower may be transported therewith when not in use, wherein the means for supporting the flexible water conduit in the assembled configuration is comprised of:

a plurality of support portions, each of said support portions axially removably secured to one another when in the assembled configuration forming an integral knockdown upstanding support, at least one of said support portions further being removably carried by the container when in the assembled configuration, wherein the support is maintained upstanding for supporting the water conduit when in use; and means for removably securing the water conduit to the integral upstanding support when in the assembled configuration, whereby the water conduit is supported when in use.

16. The knockdown portable hot water shower of claim 15, wherein the means for removably securing the water conduit to the integral upstanding support when in the assembled configuration is comprised of:

a plurality of clips, each of said clips having a first end, joined to the upstanding support and a second end, joined to the water conduit, so that the conduit is removably secured to and supported by the upstanding support when in the assembled configuration.

17. The knockdown portable hot water shower of claim 15, wherein each of the support portions includes a pair of threaded ends, and further wherein a plurality of collars are provided for matingly engaging the adjoining threaded ends of axially adjacent support portions, such that the support portions are removably axially secured to one another forming the upstanding support when in the assembled configuration, and further such that the upstanding support may be easily knocked down and disposed in the container being nested therein when in the disassembled configuration.

18. A knockdown portable hot water shower having a disassembled configuration utilized for storing and transporting the shower when not in use, and an assembled configuration utilized for showering by an individual when in use, the knockdown portable hot water shower is comprised of:

a container for use as a storage container when the shower is in the disassembled configuration, wherein components of the portable shower are received therein for the storage thereof, and further for use as a reservoir when the shower is in the assembled configuration, wherein water is received and heated therein for the use thereof;

a gas burner including a burner head which is positioned above the gas burner and both of which are positioned below the container when the shower is in the assembled configuration, wherein the water in the container is heated for showering by an individual when in use, the gas burner and burner head sized for being received in the container when the shower is in the disassembled configuration, wherein the gas burner is stored when not in use;

means for supporting the container above the gas burner;

a flexible water conduit having a first lower end and a second upper end, the conduit extending upwardly from the container when the shower is in the assembled configuration, wherein hot water is delivered upwardly through the conduit from the first end to the second end for showering by an individual when in use;

a shower head carried by the second end of the flexible water conduit above the container when the shower is in the assembled configuration, wherein hot water delivered from the second end of the conduit passes therethrough and is delivered therefrom as a hot water spray for showering by an individual when in use, the shower head being received in the container when the shower is in the disassembled configuration, wherein the shower head is stored when not in use;

means for supporting the flexible water conduit with the second end carrying the shower head thereon above the first end of the conduit when the shower is in the assembled configuration;

a pump between the water in the container and the first end of the water conduit when the shower is in the assembled configuration for pumping the hot water from the container, wherein hot water is delivered for showering by an individual when in use;

wherein when the shower is in the assembled configuration, the shower may be readily knocked-down into the disassembled configuration and the components thereof may be carried by the container with at least a portion of the components nested therein; and the container including a handle for transporting the portable shower when in the disassembled configuration, wherein all of the components of the shower may be transported therewith when not in use, a lid removably disposed over the container, thereby sealing the container for storing and retaining the water therein when the shower is in the assembled configuration and further for storing and retaining components therein when the shower is in the disassembled configuration, wherein the pump is carried by the lid in the assembled and disassembled configurations.

19. A knockdown portable hot water shower having a disassembled configuration utilized for storing and transporting the shower when not in use, and an assembled configuration utilized for showering by an individual when in use, the knockdown portable hot water shower is comprised of:

a container for use as a storage container when the shower is in the disassembled configuration, wherein components of the portable shower are received therein for the storage thereof, and further for use as a reservoir when the shower is in the assembled configuration, wherein water is received and heated therein for the use thereof;

a gas burner including a burner head which is positioned above the gas burner and both of which are positioned below the container when the shower is in the assembled configuration, wherein the water in the container is heated for showering by an individual when in use, the gas burner and burner head sized for being received in the container when the shower is in the disassembled configuration, wherein the gas burner is stored when not in use;

means for supporting the container above the gas burner;

a flexible water conduit having a first lower end and a second upper end, the conduit extending upwardly from the container when the shower is in the assembled configuration, wherein hot water is delivered upwardly through the conduit from the first end to the second end for showering by an individual when in use;

a shower head carried by the second end of the flexible water conduit above the container when the shower is in the assembled configuration, wherein hot water delivered from the second end of the conduit passes therethrough and is delivered therefrom as a hot water spray for showering by an individual when in use, the shower head being received in the container when the shower is in the disassembled configuration, wherein the shower head is stored when not in use;

means for supporting the flexible water conduit with the second end carrying the shower head thereon above the first end of the conduit when the shower is in the assembled configuration;

a pump between the water in the container and the first end of the water conduit when the shower is in the assembled configuration for pumping the hot water from the container, wherein hot water is delivered for showering by an individual when in use;

wherein when the shower is in the assembled configuration, the shower may be readily knocked-down into the disassembled configuration and the components thereof may be carried by the container with at least a portion of the components nested therein; and the container including a handle for transporting the portable shower when in the disassembled configuration, wherein all of the components of the shower may be transported therewith when not in use, wherein the means for supporting the flexible water conduit in the assembled configuration is comprised of:

a plurality of support portions, each of said support portions axially removably secured to one another when in the assembled configuration forming an integral knockdown upstanding support, at least one of said support portions further being removably carried by the container when in the assembled configuration, wherein the support is maintained upstanding for supporting the water conduit when in use;

means for removably securing the water conduit to the integral upstanding support when in the assembled configuration, whereby the water conduit is supported when in use, wherein the plurality of support portions includes an uppermost support portion having a bend formed therein forming an outwardly extending portion, the outwardly extending portion further having a slot formed therein at the bend thereof and extending along the outwardly extending portion, whereby the water conduit including the second end thereof may be received and supported in the slot with the shower head being substantially outwardly directed to deliver the hot spray of water to an individual when in use.

20. A lightweight knockdown portable hot water shower for use in remote areas, comprising, in combination:

a container of water;

means to elevate the water from a lower temperature to a higher temperature, said temperature elevation means configured with said container as a free-standing tank; and a means to atomize said water at a height above a person using said shower, whereby said atomizing means is coupled to said container, wherein said atomization means includes:

a shower head consisting of an inlet leading to an empty space surrounded by a back wall receiving said inlet, and a shower face opposite said back wall and connected to said back wall by a side wall radially surrounding said empty space;

a set of apertures formed in the shower face, wherein the apertures are substantially cylindrical in shape allowing formation of an appropriate discharge of water, including both an inner five-point star configuration and an outer five-point star configuration, which together approximate a pentagon formation;

a pump between the water in said container and the lower first end of a water conduit, thereby delivering the water from said container through said water conduit to said inlet of said shower head, wherein said pump delivers water such that a fine spray of water is delivered for showering by an individual when in use, wherein said temperature elevation means and free-standing configuration include:

a support housing having a bottom wall, upwardly extending side walls, a plurality of stabilizing legs extending radially outward from the lower portion of said side walls, a plurality of support uprights carried by said side walls and extending upwardly therefrom, each of said uprights having a shoulder, such that said container is received on and supported by said shoulders, a plurality of openings in said side walls providing access for air and burner adjustments;

and a gas burner including a burner head, both being positioned within the support housing and below said container, wherein the water in said container is heated to an increased temperature.

21. The shower of claim 20 wherein the components of said shower may be broken down into individual units such that all components will fit within said container forming a single easily transportable unit, said container having a handle attached to said upwardly extending walls of said container for use in transporting said shower in its disassembled configuration.

22. A lightweight knockdown portable hot water shower for use in remote areas, comprising, in combination:

a container of water;

means to elevate the water from a lower temperature to a higher temperature, said temperature elevation means configured with said container as a free-standing tank; and a means to atomize said water at a height above a person using said shower, whereby said atomizing means is coupled to said container.

wherein said temperature elevation means and free-standing configuration include:

a support housing having a bottom wall, upwardly extending side walls, a plurality of stabilizing legs extending radially outward from the lower portion of said side walls, a plurality of support uprights carried by said side walls and extending upwardly therefrom, each of said uprights having a shoulder, such that said container is received on and supported by said shoulders, a plurality of openings in said side walls providing access for air and burner adjustments:

and a gas burner including a burner head, both being positioned within the support housing and below said container, wherein the water in said container is heated to an increased temperature.

23. The shower of claim 22 wherein the components of said shower may be broken down into individual units such that all components will fit within said container forming a single easily transportable unit, said container having a handle attached to said upwardly extending walls of said container for use in transporting said shower in its disassembled configuration.

* * * * *